United States Patent [19]

O'Donnell

[11] Patent Number: 4,483,534

[45] **Date of Patent: * Nov. 20, 1984**

[54] MOUNTING ASSEMBLY OF CONTROLLED RESILIENCE FOR BASKETBALL GOAL HOOP

[75] Inventor: John F. O'Donnell, Peoria, Ill.

[73] Assignee: Saflex Systems, Peoria, Ill.

[ * ] Notice: The portion of the term of this patent subsequent to Feb. 3, 1998 has been disclaimed.

[21] Appl. No.: 415,417

[22] Filed: Sep. 7, 1982

Related U.S. Application Data

[63] Continuation of Ser. No. 176,721, Aug. 15, 1980, Pat. No. 4,348,022.

[51] Int. Cl.[3] ..... A63B 63/08

[52] U.S. Cl. ..... 273/1.5 R

[58] Field of Search ..... 273/1.5 R; 172/264, 172/265

[56] References Cited

U.S. PATENT DOCUMENTS 198,320 12/1887 Stoddard ..... 172/265
4,111,420 9/1978 Tyner ..... 273/1.5 R
4,348,022 9/1982 O'Donnell ..... 273/1.5 R
4,365,802 12/1982 Ehrat ..... 273/1.5 R

OTHER PUBLICATIONS

Slam Dunk Rim, Inc. Types 1 and 3, 4–1978.

*Primary Examiner*—Paul E. Shapiro
*Attorney, Agent, or Firm*—David H. Hill

[57] ABSTRACT

A plate is mounted to a basketball backboard by bolts passing through the four standard bolt holes and forms a horizontal fulcrum. A standard hoop having a conventional L-shaped mounting bracket is positioned with the vertical leg thereof abutting the plate. A bolt passes from the plate through a hole in the vertical leg. A resilient shock absorbing mass is mounted between the outer face of the vertical leg and the end of the bolt, and acts as a shock absorbing device when the goal hoop is deflected about the fulcrum due to downwardly directed forces applied to the hoop. The shock absorbing device is positioned centrally with respect to the four mounting holes with all parts thereof ahead of the front face of the backboard.

10 Claims, 9 Drawing Figures

Fig 3.
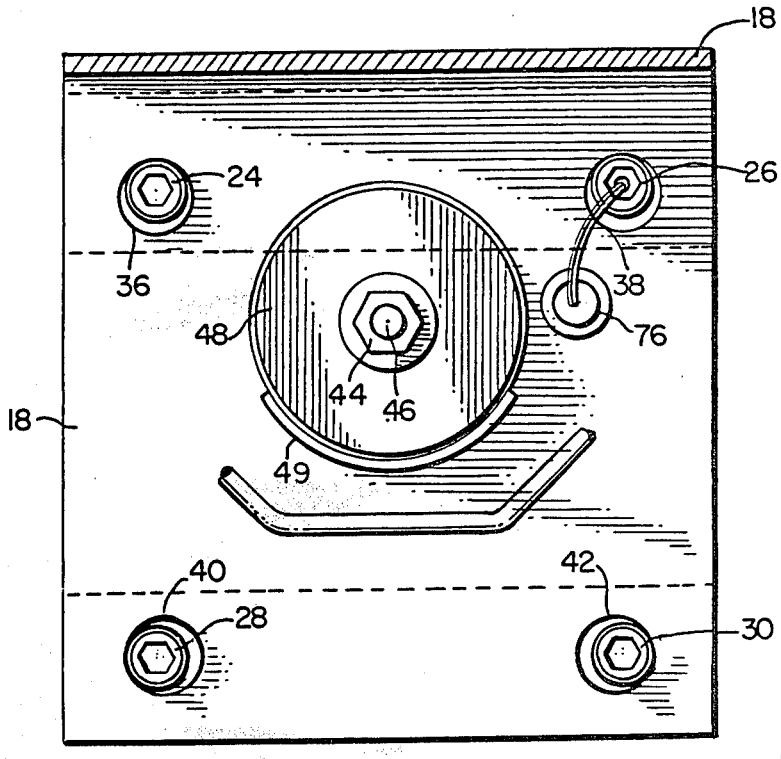
Fig 4.
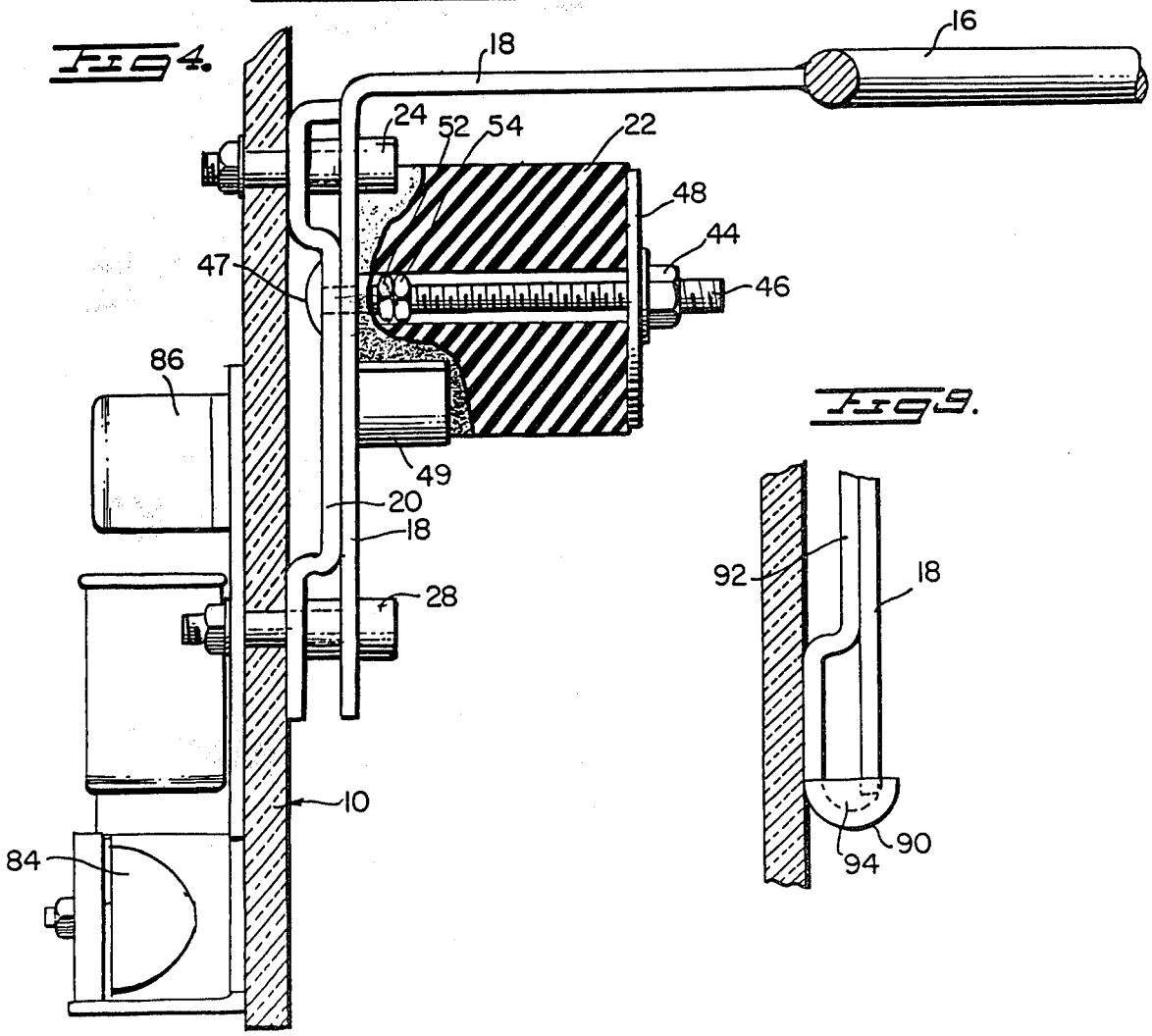
Fig 9.

Fig 5.
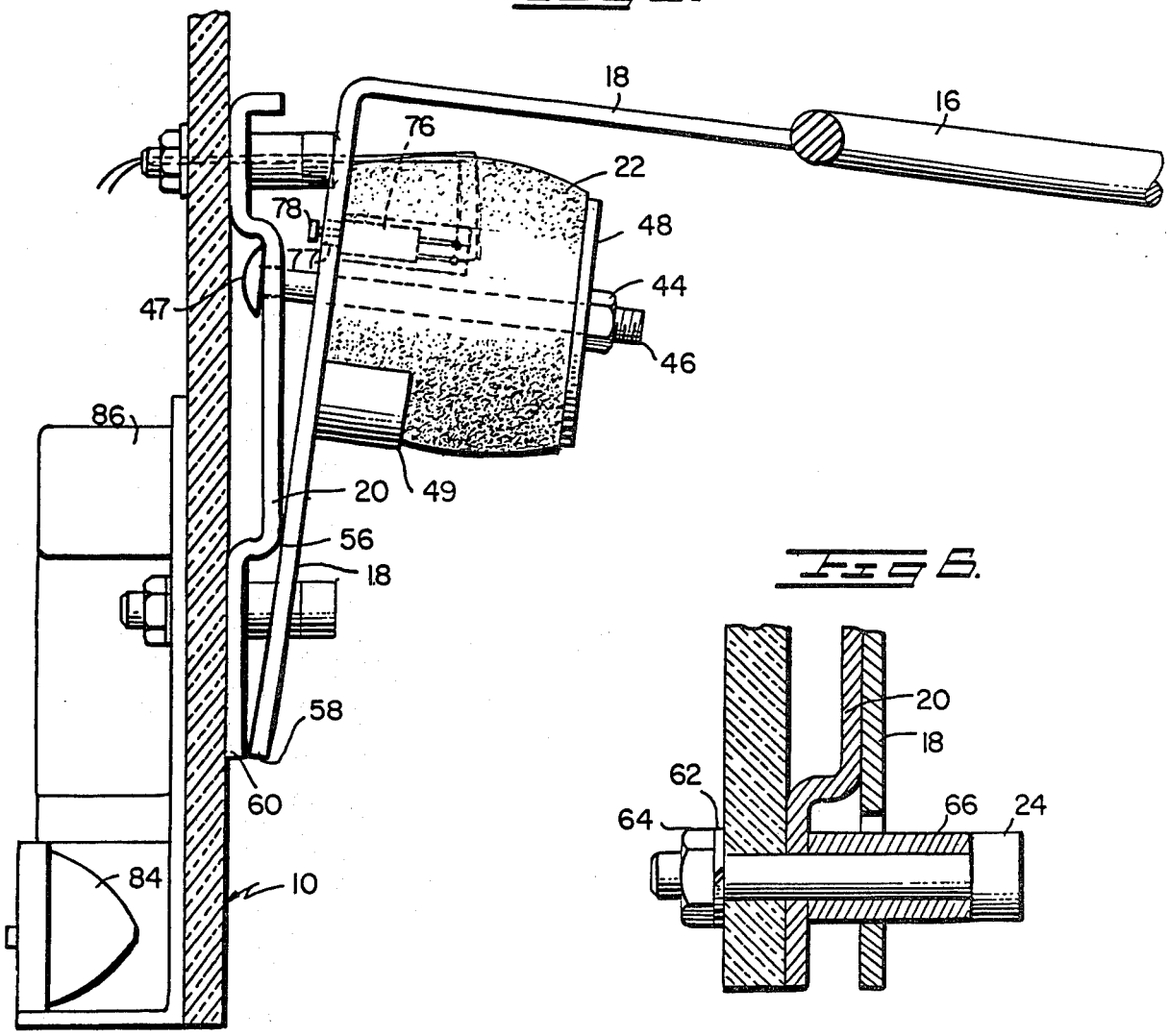
Fig 6.
Fig 7
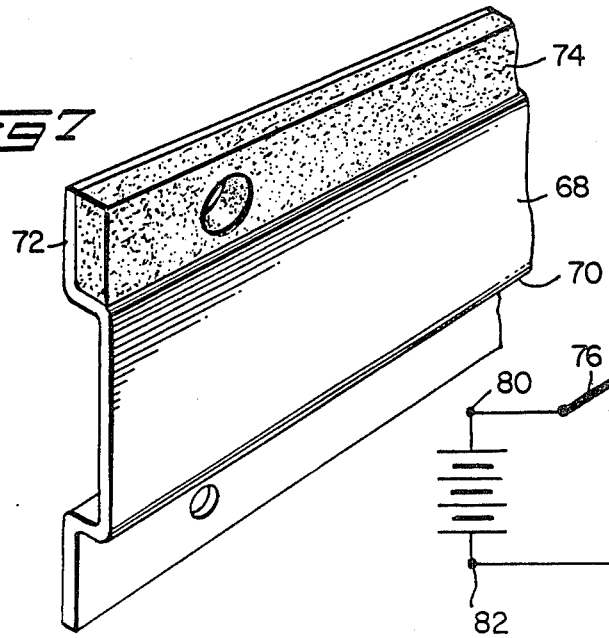
Fig 8.
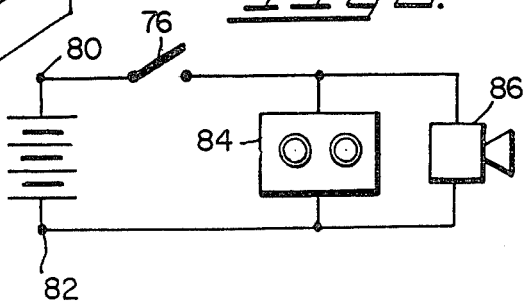

MOUNTING ASSEMBLY OF CONTROLLED RESILIENCE FOR BASKETBALL GOAL HOOP

This application is a continuation, of application Ser. No. 176,721, filed Aug. 15, 1980, now U.S. Pat. No. 4,348,022.

BACKGROUND OF THE INVENTION

1. Field of the Invention

This invention pertains generally to goal hoops for the game of basketball and the like, and more particularly to a mounting assembly for a basketball goal hoop wherein means are provided to prevent damage to the overall assembly or injury to a player's hand or arm in those instances in which the player's limbs come into contact, deliberately or accidentally, with the goal hoop. It has become common for the backboard for a basketball goal to be made of glass or the like, and where a player intentionally touches and places a downward stress on the hoop, or even in those instances, such as in the well-known "dunk shots", where the player accidentally comes into contact with the rim, it has often happened that the glass backboard has been fractured by the resultant relative movement between the goal hoop and the backboard, creating a hazardous situation for immediately adjacent participants, and has, as well, caused unwarranted delays in the game while replacement equipment is installed.

2. Description of the Prior Art

Some attempts have been made in the past to provide a resilient connection between the goal hoop and the backboard, attempts that have included means intended for absorbing the energy of the player contact with the rim of the hoop, so as to reduce the mechanical strain placed on the goal assembly and particularly between the goal hoop and the stationary backboard. However, the prior art endeavors in this field have either failed to provide the necessary degree of resilience, or have involved such complicated mechanical arrangements as to render them impractical. Patented examples of such prior-art assemblies include the disclosures of U.S. Pat. Nos. 4,111,420 and 4,194,734, both issued to Frederick C. Tyner, and U.S. Pat. No. 3,802,702, issued to Harvey E. Pulley. U.S. Pat. No. 3,752,477, issued to Thomas R. Hoyt, discloses an analogous basketball goal having a suction-cup mounting means which inherently provides resiliency in the mounting, but for entirely different reasons. Further, the prior art has also utilized so-called "break-away" assemblies in which the means mounting the goal hoop simply collapse or break away from their normal positions, the various members of the assembly being designed to be released from their normal supporting interconnections without actual disassembly of the various parts of the mount. However, even in this type of goal hoop mounting assembly the playing of the game must be interrupted while officials or others readjust or reassembly the collapsed assembly to its operative and supporting position. An additional drawback of this so-called "break-away" mount is that it permits the hoop and associated mounting means to collapse and strike the contestants on the head, shoulders or arms, resulting in injuries which have become the subject of litigation in some instances.

SUMMARY OF THE INVENTION

The mounting assembly of the present invention provides the needed degree of resilience between the goal hoop and backboard without involving the cumbersome mechanical arrangements of the prior art, as particularly emphasized by a comparison with the aforementioned prior-art patents. In short, in accordance with the present invention, the usual basketball goal hoop with the standardized L-shaped mounting bracket is mounted on the standardized backboard by means of a special intermediate bracket and cylindrical energy-absorbing polymer mass at least portions of which are displaced when the goal hoop or rim is pivoted downwardly, as by playing contact, accidental or otherwise. By means of this simple solution to the problem, downward pivotal motion of the hoop is permitted without placing undue strain on the backboard or the intermediate mounting assembly, and by the same means that permits this downward movement of the rim the latter is subsequently and rapidly returned upwardly to its initial or proper position in order that play of the game may continue uninterrupted. In this connection, it is also a characteristic of the mounting assembly of the present invention to provide the aforementioned resilience for the goal hoop when subjected to undue downward pressure while at the same time affording a normal degree of stiffness or resistance to such downward movement when the hoop is subjected to normal downward pressures such as might be expected in the bouncing of the ball off the hoop in a close, but missed, shot, thereby providing a normal rebound of the ball from the rim in the case of such a shot by a contestant in a game of basketball.

Since player contact with the rim of the goal hoop can be a technical foul, it is important to be able to provide an accurate indication of such contact, and the present invention also contemplates the use of a sensitive electrical switch to detect pivotal motion of the goal hoop downwardly relative to the fixed backboard, the switch being utilized to actuate a suitable signal or alarm, whether in the form of flashing lights, an audible buzzer or some combination thereof.

BRIEF DESCRIPTION OF THE DRAWINGS

FIG. 3 is a front elevation view similar to that of FIG. 2 but with the goal hoop (the net not being shown) and the remaining mounting assembly members in place, FIG. 4 is a side elevation view of the assembly shown in FIG. 3, showing the mounting assembly in the normal or unflexed position, FIG. 5 is a side elevation view similar to that of FIG. 4, but with the goal hoop deflected downwardly, showing the resilient mounting means in the flexed position, FIG. 6 is a detail view of the means which serve the dual functions of connecting the mounting bracket to the backboard and providing guides for movement of the goal hoop relative to the backboard, FIG. 7 is a perspective view of a modified form of the mounting bracket shown in the previous figures, FIG. 8 is a representative circuit diagram of an alarm circuit, and FIG. 9 is a partial side elevation similar to FIG. 4, but showing an alternative embodiment of the mounting bracket.

DESCRIPTION OF A PREFERRED EMBODIMENT

Figure 1:
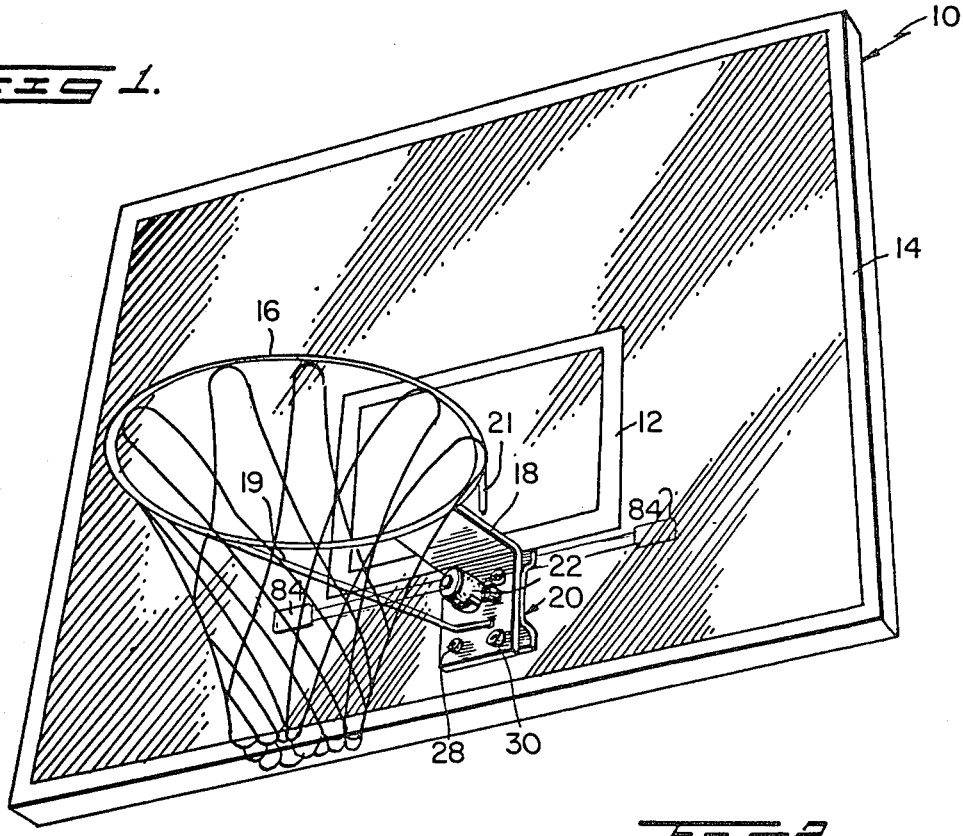
FIG. 1 is a perspective view of a standard basketball hoop mounted on a standard backboard by means of the mounting assembly of the present invention.

Referring now to FIG. 1 in particular, a standard backboard 10 of glass or the like is shown with appropriate indicia 12 and 14 thereon. A goal hoop 16 having appropriate fabric netting attached thereto is attached to the backboard 10 at a standard position near the bottom edge of the board at a position determined by four standardized mounting apertures (not shown in FIG. 1) well known in the art. The basketball goal hoop includes a standard L-shaped mounting bracket 18 integral therewith, along with the usual support arms 19 and 21, the bracket 18 being mounted on the backboard 10 by means of the resilient mounting assembly of the present invention, bracket 20 and resilient mass 22 of which are shown in FIG. 1, with the remaining members of the mounting assembly and a description thereof being included in the subsequent figures and their description. Suffice it to say that, as shown in FIG. 1, the resilient mounting assembly of the present invention serves to connect the goal hoop 16 and its integral L bracket 18 to the backboard 10 in a manner closely resembling the ordinary non-resilient mounting arrangement common in basketball courts today.

Figure 2:
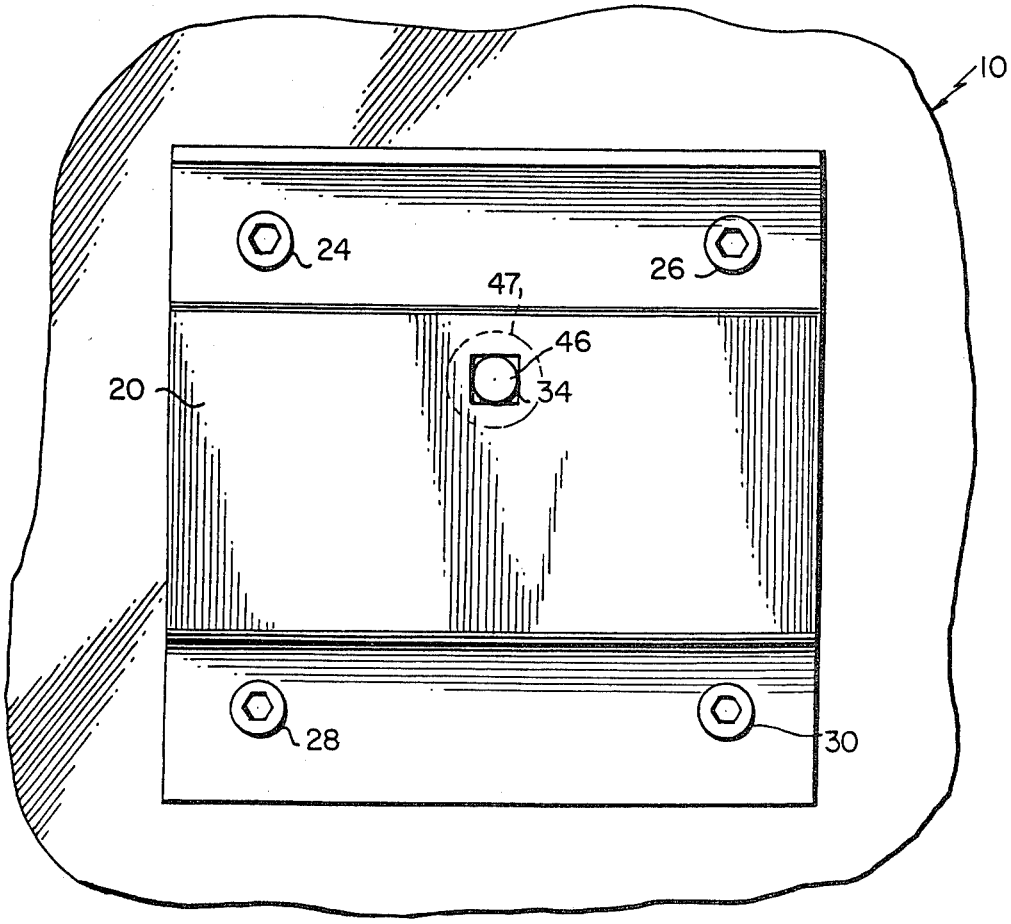
FIG. 2 is a fragmentary front elevation of a portion of a standard backboard with standardized mounting apertures therein and showing the mounting bracket of the present invention attached thereto, but with other members removed.

FIG. 2 shows in front elevation a portion of a standard backboard with the standardized mounting apertures commonly located in a square with five inches between centers; in FIG. 2 the apertures in the backboard 10 are occupied by respective cap screws 24, 26, 28 and 30, the heads of which are seen in FIG. 2. These four cap screws serve, in combination with auxiliary sleeves as will be described in connection with FIG. 6, to connect the mounting bracket 20 to the backboard 10, the bracket 20 acting,in turn, to mount the remaining members of the assembly. In addition to the four apertures through which the four aforementioned cap screws pass through the bracket 20, there is a fifth aperture 34 located as shown in a position slightly above the center of the square formed by the four mounting apertures through which the cap screws pass; the significance of this fifth aperture 34 will be explained in connection with the description of subsequent figures.

FIG. 3 is a elevation view similar to that of FIG. 2 but with the remaining members of the assembly being shown, at least in part (the net suspended from the goal hoop not, however, being shown). As may be seen in FIG. 3, the mounting bracket 20 of substantially flattened U-shape is mounted in place on backboard 10 by means of the cap screws 24, 26, 28 and 30, each of these screws extending through a respective enlarged aperture 36, 38, 40 and 42 in the elbow bracket 18 of the goal hoop 16. As will become more apparent as the description of the assembly proceeds, the cap screw 24 fitting in sliding engagement in enlarged aperture 36 serves as a guide for relative movement of the elbow bracket 18 relative to the stationary bracket 20. Similarly, cap screw 26 serves as a guide by means of a sliding fit in aperture 38, cap screw 28 acts similarly within enlarged aperture 40 and cap screw 30 serves the same purpose within enlarged aperture 42.

As may be seen from an inspection of FIG. 3, upper cap screws 24 and 26 (as well as their respective associated spacing sleeves, not shown in FIG. 3) are in sliding contact with the upper internal faces of respective apertures 36 and 38, whereas lower cap screws 28 and 30 are in sliding contact with the outboard faces of respective apertures 40 and 42. By means of this arrangement of these several members, the pivotally movable elbow bracket 18 rides on and is partially supported by screws 24 and 26 (and their associated sleeves), while the bracket 18 is simultaneously held against transverse movement (to the right or to the left in FIG. 3) by the sliding contact with screws 28 and 30 (and their respective associated sleeves).

Referring to both FIG. 3 and FIG. 4, the means which provides the resilience for absorbing the energy of a moving goal hoop and the means for returning the hoop to its normal position can be seen to be a single means, viz., the resilient mass 22, which may preferably be a cylindrical mass of a suitable polymer or the like having the necessary characteristics for performing the desired function. As shown in the preferred form, the resilient mass 22 is a cylinder of polymer one end of which abuts the outer face of the vertical leg of the L bracket 18, the other end of the resilient mass 22 being covered by a suitable metal plate or washer 48 against which a nut 44 may bear when tightened down on a carriage bolt 46 extending through the resilient mass 22, the flat portion of rounded head 47 of the bolt 46 being in abutment with the inner or left-hand (as seen in FIG. 4) face of the mounting bracket 20.

As is characteristic of carriage bolts, the shank of bolt 46 adjacent the head thereof is square in cross section, and with bolt 46 in position in square aperture 34, the square portion of the bolt is engaged by the square aperture so as to hold the bolt against rotation. It may thus be seen that the L bracket 18 of the goal hoop is connected to the stationary bracket 20 through the polymer cylinder 22.

A short semicylindrical sleeve 49 is welded or otherwise secured to the outer or right-hand (as viewed in FIG. 4) face of the vertical leg of the elbow bracket 18, this semicylindrical sleeve 49 having a radius substantially equal to that of the polymer cylinder 22, whereby the sleeve fits adjacent the surface of the cylinder 22 and in effect acts as a locating means for that portion of the polymer cylinder 22.

In actually positioning the goal hoop 16 in its precise normal or unflexed position, nut 44 is tightened down on bolt 46 to a predetermined degree to provide a required pre-load on the assembly in order to provide the required degree of stiffness in the mount so as to obtain normal rebound of a ball striking the goal hoop. That is to say, though it is a primary function of the apparatus of the present invention to permit pivotal movement between the goal hoop and the backboard, in order to be acceptable for use in the ordinary playing of the game of basketball there must be present in the mounting assembly a minimum degree of stiffness or resistance to such relative motion in order to have the goal hoop provide the same rebound as a non-resiliently mounted goal hoop when struck by a ball.

As is obvious, bolt 46 extends through square aperture 34 in stationary bracket 20, through an aligned aperture 50 in the vertical leg of elbow bracket 18 and down through a central opening axial of the rubber cylinder 22 to extend beyond plate or washer 48 at the other end thereof. The diameter of the central aperture extending axially through the rubber cylinder 22 is significantly greater than the diameter of the bolt 46, in order to provide operating clearances between the movable parts. The clearance between the two can be reduced, however, for control, for example, by running a pair of nuts 52 and 54 partially down the shaft of the bolt 46 and locking the two nuts together by relative rotation therebetween.

FIG. 5 shows the relative positions of the members of the resilient assembly at the extreme position of movement of the goal hoop downwardly, resulting in a clockwise pivotal movement of the elbow bracket 18 about the fulcrum 56 formed in the stationary spacing bracket 20. That this is the extreme position is shown by the fact that the bottom end 58 of the vertical leg of the elbow bracket 18 is in abutment with the bottom end 60 of the bracket 20. As may be seen, the rubber cylinder 22 undergoes a considerable lateral displacement in absorbing the energy of this movement, and has the resilience to restore the parts to their original position shown in FIG. 4 when the downward pressure is removed from the goal hoop 16 (FIG. 4).

FIG. 6 shown one of the cap screws 24 interconnecting the bracket 20 with the backboard 10 by means of a lock washer 62 and a nut 64. In order to have these cap screws serve as guide means for the movement of the elbow bracket integral with the hoop, a sleeve 66 is placed between the head of the bolt 24 and the bracket 20, as shown in FIG. 6, thus providing an extended guide means. It will be understood that each of the other cap screws will be provided with a similar sleeve.

The spacing bracket member of the invention may be modified as shown in FIG. 7, wherein the bracket 68 includes the mounting apertures of the bracket 20 of the earlier figures and includes a pivot line 70 for pivotal movement of the goal assembly. However, rather than having an upper lip as in the bracket 20, the bracket 68 includes a flat portion 72 having no final lip thereon, and a polymer recoil pad 74 or the like of the proper dimensions and having the required mounting apertures is mounted adjacent the upper end of bracket 68 to provide an upper stop for the pivotal elbow bracket 18. It will be understood that in the case of the bracket 20 the outer end of the upper lip constitutes the stop of the upward motion of the elbow bracket 18.

Referring again to FIG. 3 and 5, an electrical switch 76 having an actuating or plunger mechanism 78 may be provided at a suitable location on the vertical leg of L bracket 18, with the plunger 78 extending through a suitable aperture 77 in bracket 18 and into contact with the near face of bracket 20. Pivotal movement of L bracket 18 (as in FIG. 5) allows plunger 78 to be extended, closing an alarm circuit. Obviously, the sensitivity of the operation of a circuit to be actuated by this switch can be adjusted by any suitable means. The circuit for producing an alarm upon relative movement between elbow bracket 18 and the stationary mounting bracket may take the form of that shown schematically in FIG. 8, wherein a source of power indicated by terminals 80 and 82 is connected through switch 76 to a set of flashing lights 84 or an audible buzzer 86 or, as shown in FIG. 8, the two indicating means could be used concurrently.

FIG. 9 shows an alternative form of the bottom of the stationary mounting bracket, wherein the bottom of the vertical leg of L bracket 18 is free to move about or pivot in a hook portion 90 at the bottom of mounting bracket 92, the ends at the channel formed by hook portion 90 being closed, as at 94.

The resilient mass 22 of the present invention is preferably a polymer, such as A.S.T.M. designation D2002BC725B14C12F17GAL or S.A.E. designation J 200. In some applications, however, rubber may serve equally well.

The invention has been disclosed in considerable detail, and with particular reference to a specific construction of a basketball hoop and elbow support therefor. However, it will be obvious to those skilled in the art that the inventive concept herein also applies to other analogous structures and, hence, the invention should not be considered as limited to the details given in describing the preferred embodiment.

What is claimed is:

1. A mounting assembly for a normally horizontal basketball goal hoop for providing a connection of controlled resilience between such goal hoop and a vertical backboard therefor having standardized mounting apertures therein, comprising:

goal hoop mounting means affixed to the front of such backboard and including means forming a horizontal fulcrum spaced away from the front of such backboard, means connecting such goal hoop to said mounting means for pivotal movement of such goal hoop about said horizontal fulcrum, and means interconnecting such goal hoop and said goal hoop mounting means for resiliently urging the former to a position in which the goal hoop is substantially horizontal, such resilient interconnecting means being positioned substantially centrally with respect to such standardized mounting apertures with all parts thereof ahead of the front face of such backboard, whereby downwardly-directed forces applied to such goal hoop are substantially absorbed in said substantially centered resilient interconnecting means in front of such backboard.

2. A mounting assembly for a normally horizontal basketball goal hoop in accordance with claim 1, and including means for variably pre-setting the assembly to execute its pivotal movement only upon the application of a force greater than that so pre-set.

3. A mounting assembly for a normally horizontal basketball goal hoop for providing a connection of controlled resilience between such goal hoop and a vertical backboard therefor having standardized mounting apertures therein, comprising:

goal hoop mounting means affixed to the front of such backboard and including means forming a horizontal fulcrum spaced away from the front of such backboard, means connecting such goal hoop to said mounting means for pivotal movement of such goal hoop about said horizontal fulcrum, and means interconnecting such goal hoop and said goal hoop mounting means for resiliently urging the former upwardly to a position in which such goal hoop is substantially horizontal, such resilient interconnecting means being positioned substantially centrally with respect to such standardized mounting apertures with all parts thereof ahead of the front face of such backboard, whereby downwardly-directed forces applied to such goal hoop are substantially absorbed in said substantially centered resilient interconnecting means in front of such backboard.

4. A mounting assembly for a normally horizontal basketball goal hoop for providing a connection of controlled resilience between such goal hoop and a vertical backboard therefor having standardized apertures therein, comprising:

goal hoop mounting means affixed to the front of such backboard and including means forming a horizontal fulcrum spaced away from the front of such backboard, means connecting such goal hoop to said mounting means for pivotal movement of such goal hoop about said horizontal fulcrum, means interconnecting such goal hoop and said goal hoop mounting means for resiliently urging the former upwardly to a substantially horizontal position, such resilient interconnecting means being positioned substantially centrally with respect to such standardized mounting apertures with all parts thereof ahead of the front face of such backboard, whereby downwardly-directed forces applied to such goal hoop are substantially absorbed in said substantially centered resilient interconnecting means in front of such backboard, and means on said goal hoop mounting means forming an abutment against which such goal hoop bears when urged upwardly to its substantially horizontal position.

5. A mounting assembly for a normally horizontal basketball goal hoop for providing a connection of controlled resilience between such goal hoop and a vertical backboard therefor having standardized mounting apertures therein, comprising:

goal hoop mounting means affixed to the front of such backboard by means of threaded connecting members extending through such standardized apertures, and including means forming a horizontal fulcrum spaced away from the front of such backboard, means connecting such goal hoop to said mounting means for pivotal movement of such goal hoop about said horizontal fulcrum, and means interconnecting such goal hoop and said goal hoop mounting means for resiliently urging such goal hoop into a substantially horizontal position, such resilient interconnecting means being positioned substantially centrally with respect to such standardized mounting apertures with all parts thereof ahead of the front face of such backboard, whereby downwardly-directed forces applied to such goal hoop are substantially absorbed in said substantially centered resilient interconnecting means in front of such backboard.

6. A mounting assembly for a normally horizontal basketball goal hoop for providing a connection of controlled resilience between such goal hoop and a vertical backboard therefor having standardized mounting apertures therein, comprising:

goal hoop mounting means affixed to the front of such backboard by means of threaded connecting members extending through such standardized apertures, and including means forming a horizontal fulcrum spaced away from the front of such backboard, means connecting such goal hoop to said mounting means for pivotal movement of such goal hoop about said horizontal fulcrum, and means interconnecting such goal hoop and said goal hoop mounting means for resiliently urging the former upwardly to a position in which such goal hoop is substantially horizontal, such resilient interconnecting means being positioned substantially centrally with respect to such standardized mounting apertures with all parts thereof ahead of the front face of such backboard, whereby downwardly-directed forces applied to such goal hoop are substantially absorbed in said substantially centered resilient interconnecting means in front of such backboard.

7. A mounting assembly for a normally horizontal basketball goal hoop for providing a connection of controlled resilience between such goal hoop and a vertical backboard therefor having standardized mounting apertures therein, comprising:

goal hoop mounting means affixed to the front of such backboard by means of threaded connecting members extending through such standardized apertures, and including means forming a horizontal fulcrum spaced away from the front of such backboard, means connecting such goal hoop to said mounting means for pivotal movement of such goal hoop about said horizontal fulcrum, means interconnecting such goal hoop and said goal hoop mounting means for resileintly urging the former upwardly to a substantially horizontal position, such resilient interconnecting means being positioned substantially centrally with respect to such standardized mounting apertures with all parts thereof ahead of the front face of such backboard, whereby downwardly-directed forces applied to such goal hoop are substantially absorbed in said substantially centered resilient interconnecting means in front of such backboard, and abutment means on said goal hoop mounting means against which such goal hoop bears when such goal hoop is urged upwardly to a substantially horizontal position.

8. A mounting assemblyfor a normally horizontal basketball goal hoop of the type having an integral mounting bracket thereon for providing a connection of controlled resilience between such goal hoop and a vertical backboard therefor having standardized mounting apertures therein, comprising:

goal hoop mounting means affixed to the front of such backboard by means of threaded connecting members extending through such standardized apertures, and including means forming a horizontal fulcrum spaced away from the front of such backboard, means connecting such mounting bracket to said mounting means for pivotal movement of such goal hoop and mounting bracket about said horizontal fulcrum, and means interconnecting such mounting bracket and said goal hoop mounting means for resiliently urging the former to a substantially horizontal position, such resilient interconnecting means being positioned substantially centrally with respect to such standardized mounting apertures with all parts thereof ahead of the front face of such backboard, whereby downwardly-directed forces applied to such goal hoop are substantially absorbed in said substantially centered resilient interconnecting means in front of such backboard.

9. A mounting assembly for a normally horizontal basketball goal hoop of the type having an integral mounting bracket thereon for providing a connection of controlled resilience between such goal hoop and a vertical backboard therefor having standardized mounting apertures therein, comprising:

goal hoop mounting means affixed to the front of such backboard by means of threaded connecting members extending through such standardized apertures, and including means forming a horizontal fulcrum spaced away from such backboard, means connecting such mounting bracket to said mounting means for pivotal movement of such goal hoop and mounting bracket about said horizontal fulcrum, and means interconnecting such mounting bracket and said goal hoop mounting means for resiliently urging the former upwardly to a substantially horizontal position, such resilient interconnecting means being positioned substantially centrally with respect to such standardized mounting apertures with all parts thereof ahead of the front face of such backboard, whereby downwardly-directed forces applied to such goal hoop are substantially absorbed in said substantially centered resilient interconnecting means in front of such backboard.

10. A mounting assembly for a normally horizontal basketball goal hoop of the type having an integral mounting bracket thereon for providing a connection of controlled resilience between such goal hoop and a vertical backboard therefor having standardized mounting apertures therein, comprising:

goal hoop mounting means affixed to the front of such backboard by means of threaded connecting members extending through such standardized apertures, and including means forming a horizontal fulcrum spaced away from the front of such backboard, means connecting such mounting bracket to said mounting means for pivotal movement of such goal hoop and mounting bracket about said horizontal fulcrum, means interconnecting such mounting bracket and said goal hoop mounting means for resiliently urging the former upwardly to a position in which such goal hoop is substantially horizontal, such resilient interconnecting means being positioned substantially centrally with respect to such standardized mounting apertures with all parts thereof ahead of the front face of such backboard, whereby downwardly-directed forces applied to such goal hoop are substantially absorbed in said substantially centered resilient interconnecting means in front of such backboard, and abutment means on said goal hoop mounting means against which such integral mounting bracket bears when such goal hoop is in a substantially horizontal position.

* * * * *